US005366539A

United States Patent [19]

Abele et al.

[11] Patent Number: 5,366,539

[45] Date of Patent: Nov. 22, 1994

[54] PROCESS FOR THE DESULPHURIZATION TREATMENT OF PIG IRON MELTS

[75] Inventors: Karl-Heinz Abele, Dinslaken; Heinz van den Boom; Alfred Ender, both of Duisburg; Eckart Hees, Dinslaken; Walter Meichsner, Krefeld, all of Germany

[73] Assignee: Thyssen Stahl AG, Duisburg, Germany

[21] Appl. No.: 931,716

[22] Filed: Aug. 18, 1992

[30] Foreign Application Priority Data

Aug. 28, 1991 [DE] Germany ..... 4128499

[51] Int. Cl.[5] ..... C21C 7/06; C21C 7/064

[52] U.S. Cl. ..... 75/532; 75/533; 75/536; 75/537; 75/539

[58] Field of Search ..... 75/532, 533, 537, 539, 75/536

[56] References Cited

U.S. PATENT DOCUMENTS 3,955,966 5/1976 Meichsner .
4,832,739 5/1989 Meichsner et al. ..... 75/58
4,915,732 4/1990 Cameron et al. ..... 75/537

FOREIGN PATENT DOCUMENTS 0070912 7/1981 European Pat. Off. .
2514368 4/1983 France .
3942405 6/1991 Germany .

OTHER PUBLICATIONS

G. E. DeRusha, Jr., "Sequenced Iron Desulfurization by Calcium Carbide/Mg Co-Injection", 73rd Steelmking Conf. Proc., vol. 73, No. 24, Mar. 1990, pp. 351-355.

*Primary Examiner*—Melvyn J. Andrews
*Attorney, Agent, or Firm*—Meltzer, Lippe, Goldstein et al.

[57] ABSTRACT

The invention relates to a process for the desulphurization treatment of a pig iron melt in a container. The characterizing feature of the invention is that the treatment is performed in three phases:

In the initial phase such solids are injected that deoxidize the initial slag and increase its basicity and also produce a circulatory movement of the melt and form a basic deoxidized cover slag. In the middle phase the desulphurizing agent is injected for the main desulphurization and in the final phase such solids are injected that purify the melt and produce a final desulphurization and also so influence the desulphurization slag formed that its content of iron granules is low.

23 Claims, 1 Drawing Sheet

Course of desulfurization with 5 seperately added compounts

Course of desulfurization with 5 seperately added compounts

Course with 4 components

Course with 3 components

PROCESS FOR THE DESULPHURIZATION TREATMENT OF PIG IRON MELTS

BACKGROUND OF THE INVENTION

The invention relates to a process for the metallurgical treatment of pig iron melts in a container, more particularly a transfer ladle, which have an acid oxidized initial slag, by the injection of fine-grained solids into the melt with a carrier gas via an injection lance, and also to a variant wherein the initial slag is removed prior to the treatment of the pig iron melt and a new covering slag is formed.

In the desulphurization of pig iron it is known to fluidize separately two treatment materials, for example, an alkaline earth carbonate, such as calcium carbonate, and a metallic reducing agent, such as fine-grained magnesium (DE OS 27 08 424, DE OS 26 50 113, U.S. Pat. No. 3,998,625) or a mixture of two treatment materials and a further treatment material, for example, calcium carbide and a gas-generating coal in the form of a mixture and fine-grained magnesium (EP OS 0 226 994), or three treatment substances, for example, calcium carbide, a gas-generating coal and finely divided magnesium (U.S. Pat. No. 4,832,739) and to unite the fluidates immediately prior to their entry into the melt.

This injection technique (known as coinjection) has led to an improvement in the desulphurization of pig iron melts. In a further development of the coinjection of calcium carbide and magnesium in a ratio of 3.5:1, a preliminary treatment and an after-treatment have also been performed using approximately 90 kg and approximately 136 kg of calcium carbide respectively (73rd Steel-making Conference Proceedings, Vol. 73, Detroit Meeting, March 25–28, 1990, pages 351–355). Another similar process is known from DE OS 39 42 405. However, disadvantages continue to occur:

1. Pig iron produced in a blast furnace has an acid oxidized initial slag. If, as in the aforedescribed prior art processes, desulphurization is performed in the initial phase with fine-grained magnesium, the magnesium sulphides (MgS) forming may not be absorbed by the slag.
2. It is impossible to adjust an optimum adequate dispersion of the desulphurization agents or a circulatory movement of the bath adapted to the course of the reaction.
3. It is impossible to perform an optimum feed of finely divided magnesium adapted to the sulphur content of the pig iron melt at any particular moment.
4. It is impossible to achieve an optimum conditioning-/modification of the final slag - i.e., to reduce the absorption of iron. Furthermore, it is impossible to perform the optimum flushing out of floating magnesium sulphides in the melt or to let dissolved magnesium to react with the sulphur of the melt.

It is an object of the invention to influence the initial slag so that it can absorb the magnesium sulphides and to ensure an optimum dispersion of the desulphurization agents in the melt with a circulatory movement of the bath which is optimally adapted to the course of the reaction. Another aim is to eliminate interfering influences due to an uncontrolled resulphurization, so that the addition of fine-grained magnesium is better adapted to the sulphur content of the melt, and the modification of the slag to limit the absorption of iron therein and also the flushing of the magnesium sulphides out of the melt can be improved.

SUMMARY OF THE INVENTION

This problem is solved in a process of the kind described in the introduction by the features that in the initial phase such solids are injected which deoxidize the initial slag and increase its basicity and also produce a circulatory movement of the melt, in the middle phase one or more desulphurizing agents is or are injected for the main desulphurization, and in the final phase such solids are injected which purify the melt and produce a final desulphurization and also to influence the desulphurization slag formed that its content of iron granules is low.

In a variant of the process the acid oxidized initial slag is removed prior to the treatment of the pig iron melt. In that variant in the initial phase such solid substances are injected which form a basic deoxidizing slag covering the pig iron melt and produce a circulatory movement of the melt.

The features of the two other phases are the same as above.

In contrast to the prior art desulphurization processes wherein from the start of the treatment desulphurization agents are injected into the pig iron melt, according to the invention a treatment in the form of an initial phase precedes the actual desulphurization phase, which is followed by a further treatment as a final phase. In this way the aforedescribed disadvantages can be advantageously avoided and an improved desulphurization of the pig iron melts achieved.

Preferably in the initial phase (I) deoxidizing and/or lime-containing and/or gas-generating solids are injected, in the middle phase (II) of the treatment desulphurizing substances in the form of magnesium carriers and/or calcium compounds are injected, possibly with gas-generating solids and fluxing agents.

The lime-containing solids can be selected from the group formed by lime, limestone and dolomite. The gas-generating solids for the initial phase are selected from the group formed by flame coal, gas flame coal, lignite, limestone and dolomite, whereas the gas generating solids for the 2nd and 3rd phases are selected from the group formed by flame coal, gas flame coal, lignite and diamide lime.

The deoxidizing solids which are injected into the pig iron melt during the first phase are selected from the group formed by aluminium and polyethylene. Polyethylene acts directly in the slag zone and reduces oxygen activity; as a whole, the absorption capacity of the initial slags for sulphides is enhanced.

The calcium compounds which are injected as desulphurization agents into the pig iron melt during the middle phase and the final phase are selected from the group formed by flowable reactive lime and industrial calcium carbide. The magnesium vehicles injected into the pig iron melt during the middle phase of the treatment are selected from the group formed by metallic magnesium, with or without coatings, on its own or mixed with lime, $CaC_2$, calcium aluminates, aluminium-containing ball mill dust, alumina and magnesium oxide.

The fluxing agents injected into the melt in the final phase of the treatment are selected from the group formed by fluorspar and soda ash (sodium carbonate).

According to a further feature the lime-containing solids can be mixed with an aluminium-containing material. The same applies to the calcium carbide carriers. In an embodiment the aluminium-containing solids are selected from the group formed by aluminium, crude or secondary aluminium pig and aluminium-containing ball mill dust (dross).

In the process according to the invention preferably in the initial phase of the treatment lime-containing and gas-separating solids are injected into the melt, to deoxidize the initial slag and to produce a circulatory movement of the melt. Addition of lime-containing solids, such as lime, as a basic carrier, increases the basicity of the slag and in this way achieves neutralization. The melt is agitated by the gas-separating solids together with the injected carrier gas. The silicon and iron oxide (FeO) of the melt react by means of the circulatory movement produced in the sense of a deoxidization to give silica ($SiO_2$) and iron (Fe).

In the middle phase of the treatment the desulphurization agents preferably injected are magnesium and calcium carbide, the slag pretreated in the manner disclosed being able to absorb the magnesium sulphides produced. It is also advantageous to inject gas-generating solids in this phase.

In the final phase of the treatment preferably calcium carbide carriers and gas-generating solids are injected into the melt. The generated gases together with the carrier gas contribute to flush out the magnesium sulphides floating in the melt and react magnesium dissolved in the melt with sulphur. Possibly also fluxing agents are injected for slag conditioning. The desulphurization slag formed is influenced by these substances in such a way that its content of iron granules is low.

In the process according to the invention, therefore, unlike the prior art desulphurization processes, a plurality of solids-base carriers, deoxidants, desulphurization agents, gas-generating agents, slag conditioners-are injected into the pig iron melt in optimum timed quantities independently of one another. The solids can be injected into the melt during the individual treatment phases simultaneously or successively and the quantities per unit of time can be adapted to the instantaneous sulphur content.

In another preferred embodiment of the process according to the invention the fine-grained solids are taken individually from separate pressurized feed vessels and injected into the melt via a common conveying pipe connected to an injection lance. In this way an optimum proportioning of the individual solids can be achieved.

However, according to an embodiment in each case two or three fine-grained solids can be taken together in the form of a mixture and also individual solids from separate pressurized feed vessels and injected into the melt via a common conveying line followed by an injection lance. While in the variant of one process a separate pressurized feed vessel must be provided for each fine-grained solid, in another variant of the process the expenditure on pressurized feed vessels can be limited.

According to another feature of the invention the quantity of carrier gas injected is so controlled in dependence on the quantity of injected solids and the total quantity of agitating gas Vg that a dissipated agitating energy $ED_{diss}$ is produced in the melt of at least 100 watts per tonne of pig iron, according to the equation:

$$ED_{diss} = \frac{6.2 \times Vg \times T_1 \times \ln\left(1 + \frac{\rho_1 \times g \times H_b}{10^5 \times P_o}\right)}{G_{schm}}$$

where:

Vg = sum of the quantity of injected carrier gas, the quantity of gas released by gas generation in the melt, and the quantity of gas due to the evaporation of metallic magnesium from magnesium carriers $T_1$ = temperature of the melt in K g = gravitational constant in $m/s^2$ $\rho_1$ = density of the melt in $kg/m^3$ $H_b$ = height of the melt through which gas bubbles flow in m $P_o$ = pressure over the melt in bar Gschm = weight of the melt treated in t According to a variant of the process the dissipated energy density is preferably adjusted to values between 200 and 1000 watts per tonne of pig iron. According to a further feature of the process in the initial phase of the treatment the dissipated energy density is adjusted to values between 600 and 1000 watts per tonne of pig iron and in the middle and final phases to values between 200 and 700 watts per tonne of pig iron. Furthermore, the quantity of injected magnesium carriers is preferably reduced as the sulphur content drops, and the quantity of injected calcium compounds and also of gas-generating solids and/or the quantity of the injected feedgas are increased.

It is regarded as an advantage of the invention that the problems which are connected with the aforedescribed prior art desulphurization processes can be overcome and that due to the three-phase treatment according to the invention, an improved degree of desulphurization can be achieved. Advantageously the process according to the invention allows an adaptation of the metallurgical performance of the process with chemical engineering means, using desulphurization components adapted to the stages of the process. Further advantages are that the consumption of expensive desulphurization agents is appreciably reduced, with corresponding economic advantage. In addition, the utilization of these agents is optimized not only by avoiding oxidation and sulphur reversion, but also by the fact that the most favourable conditions in each case can be adjusted by controlling the kinetically essential parameters, namely turbulence and amount of desulphurization agents provided per unit of time. The clearly reduced consumptions of desulphurization agents have a positive effect on costs both as a whole, and also indirectly, in conjunction with low iron losses, smaller quantities of slag, short treatment times and low heat losses.

BRIEF DESCRIPTION OF THE DRAWINGS

The invention will now be explained with reference to FIGS. 1, 2 and 3, wherein.

DETAILED DESCRIPTION OF THE DRAWINGS

Figure 1:
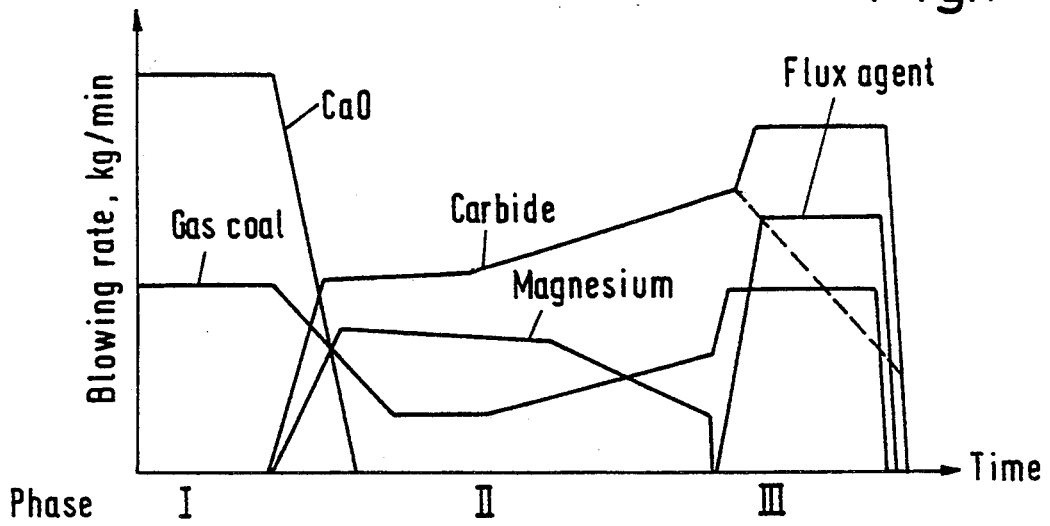
FIG. 1: shows the course of desulphurization of a pig iron melt using five separately supplied materials

As FIG. 1 shows diagrammatically, in the initial phase of the treatment the pig iron melt, which is contained, for example, in a transfer ladle, is vigorously agitated by the gas generated from the gas coal; at the same time the slag is deoxidized by the decomposition products of the gas coal and by reaction of the silicon content of the pig iron to give silica and Fe. To increase basicity, lime (CaO) is fed for a short time. In the middle phase of the treatment, as the lime rate is reduced, fine-grained magnesium is intensively injected together with calcium carbide at a relatively low rate into the melt; the addition of gas coal being throttled to reduce the turbulence in the melt. The addition of magnesium is reduced in correspondence with the course followed by the sulphur content in the melt. In compensation, calcium carbide and coal are intensified to reinforce the movement of the bath.

At the start of the final phase of treatment, after the magnesium addition has been discontinued, either calcium carbide continues to be injected as required, or the addition is reduced; at the same time the melt is vigorously agitated, on the one hand by the carrier gas and on the other by the gas generated from the gas coal. In this way the magnesium sulphides are advantageously flushed out of the melt. In the final phase of the treatment a fluxing agent is injected into the melt to condition the slag. In this embodiment the five solids used, namely, lime, gas coal, calcium carbide, magnesium and fluxing agent, are disposed individually in separate pressurized feed vessels from which they are taken and injected into the melt via a common feed line connected to an injection lance. The pressurized feed vessels have known controllable metering valves by means of which the solids can be injected into the melt simultaneously or successively and the quantities per unit of time varied, as shown in FIG. 1.

Figure 2:
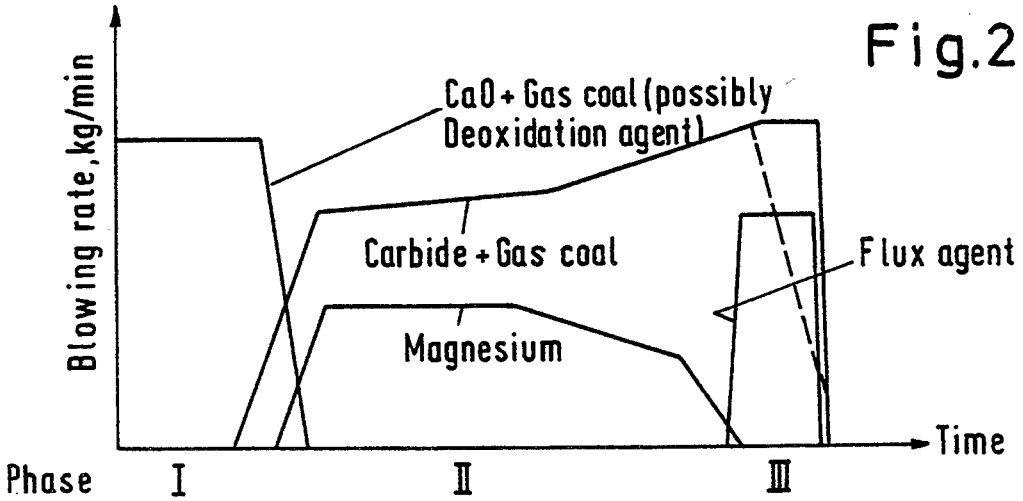
FIG. 2: shows the course of desulphurization of a pig iron melt using two mixtures and two individual materials-i.e., a total of four components.

In the embodiment illustrated in FIG. 2 the solids are lime and gas coal which are injected into the pig iron melt in the initial phase of the treatment, and the solids calcium carbide and gas coal which are injected into the pig iron melt during the middle phase and the final phase, each of them being contained in the form of a mixture in a pressurized feed vessel. As a result, the equipment cost requirements can be reduced by one vessel, although due to the use of two mixtures, the purposeful influencing of the pig iron melt can be performed in somewhat less than an optimum manner in comparison with the embodiment illustrated in FIG. 1.

Figure 3:
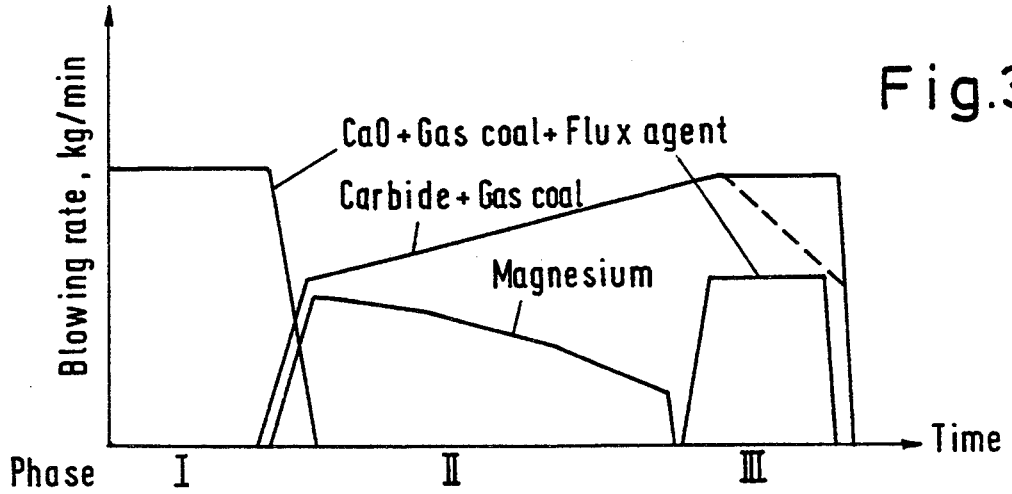
FIG. 3 shows the course of desulphurization of a pig iron melt using two mixtures and an individual material-i.e., a total of three components.

The embodiment illustrated in FIG. 3 is a further variant of the treatment process according to the invention, wherein on the one hand the components lime, gas coal and fluxing agent and on the other hand the components calcium carbide and gas coal are provided in the form of mixtures and magnesium in the form of an individual solid in separate pressurized feed vessels. In this way the apparatus cost of the pressurized feed vessels can be further reduced.

It also applies to this embodiment that the purposeful influencing of the pig iron melt and of the initial slag can be performed to a somewhat less optimum degree in comparison with the embodiment illustrated in FIG. 1.

The invention will now be further explained by comparisons and embodiments which relate to the use of desulphurization agents and the effect of desulphurization, Table 1 showing reference Examples 1 to 14, while Tables 2 to 5 show Examples 15 to 25 according to the invention.

EXAMPLES

Reference Examples

Dried compressed air was used as the feedgas in the treatments of comparison Examples 1 to 5. In treatments of reference Examples 6 to 14 the carrier gas was argon. In spite of the different ladle contents, all the treatments were comparable, due to a substantially identical depth of lance immersion. The stated flow rates of solid and carrier gas were each constant throughout the treatment. In all the treatments the pig iron temperatures were in the range 1300° to 1380° C. To make the consumptions of desulphurization agents comparable, the proportions of calcium carbide were converted to magnesium on the basis of values known from experience as regards desulphurization effectiveness. This so-called magnesium equivalent is shown as specific consumption in the last column.

Examples according to the Invention

In all the treatments of Examples 15 to 25 argon or nitrogen was used as the feedgas.

Treatment No. 15:

Pig iron quantity 232 tonnes, approximately 1.2 tonnes of ladle slag prior to the treatment, sulphur content prior to the treatment: $S_A=0.042\%$ Phase I: Injection of 1.5 kg/t=348 kg of a mixture of 90% fine lime and 10% flame coal (grain size: <0.1 mm) in 4.2 minutes with 450 Nl/min $N_2$.

Phase II: Injection of 328 kg of CaM 20 (76% industrial calcium carbide, 20% magnesium, 4% flame coal) corresponding to 1.41 kg/t, in 9.1 minutes corresponding to 36 kg/min (constant). Carrier gas: argon, 800 Nl/min (constant).

Phase III: Injection of 80 kg of a fine-grained mixture of 80% fluorspar and 20% flame coal in 2.6 minutes at 500 Nl/min. The very light slag with an obviously low iron content was finely crumbly and could be drawn off easily. The sulphur content after the treatment was 0.0048% with an Mg equivalent of 0.44 kg/t.

Treatment No. 16:

Pig iron quantity 227 tonnes, $S_A=0.036\%$

Phase I: Injection of 200 kg of a fine-grained mixture of 75% ball mill dust and 25% limestone powder in 3.2 minutes at 520 Nl/min.

Phase II: Injection from 2 different dispensers (coinjection) of 258 kg of CaC5 (95% industrial calcium carbide, 5% flame coal) at 38 kg/min (constant) together with 128 kg of Mg 50 ball mill dust (50% Mg, 50% ball mill dust) at 19 kg/min and 780 Nl argon/min.

Phase III: The flow of CaC5 was maintained and, immediately after the discontinuation of the flow of Mg 50, calcium aluminate powder (<0.3 mm, approx. 50% CaO, 44% $Al_2O_3$, residue $MgO+SiO_2$) were added from a 4th dispenser which was also connected in series. A total of 120 kg of CaC5 and 80 kg of Ca aluminate were injected in this phase. The flow of argon was increased to 1200 Nl/min (constant) to enhance the stirring effect. After the treatment the pig iron sample gave 0.0034% S; Mg equivalent=0.52 kg/t.

Treatment No. 17:

Pig iron quantity: 226 t, $S_A$: 0.038%

This experiment was carried out in the same way as Treatment No. 16, merely with slight differences in quantities and times. However, in contrast with the Treatment No. 16, during Phase II the feed deliveries were systematically altered linearly over time: CaC5 initially 24 kg/min, at the end 48 kg/min; Mg 50 ball mill dust initially 27 kg/min, at the end 12 kg/min. The quantity of carrier gas was varied accordingly between 680 and 800 Nl/min.

The final sulphur content was 0.0022% for the same Mg equivalent of 0.52 kg/t.

The data of the other experimental treatments (and also those already described) are contained in the Tables, so that merely peculiarities of the individual experiments will be disclosed hereinafter.

Treatment No. 18:

Large quantity of initial slag. Separated/deoxidized with dolomite and metallic aluminium granulate. Linearly varied feed deliveries in Phase II, similarly to Treatment No. 17.

Treatment No. 19:

The oxidized slag was substantially removed prior to the start of the treatment and a basic deoxidized slag was formed by the injection of a mixture of lime and fluorspar. The agitating and deoxidizing agent used was flame coal. Use was made of 5 dispensing pressure vessels in series, in Phase II three components being injected variably, namely a decreasing flow rate of magnesium while increasing the flow rates of carbide and flame coal while keeping constant the flow rate of carrier gas. The flow of the two latter was not interrupted at the transition to Phase III.

Treatment No. 20:

The slag was substantially removed prior to the treatment. In the final phase purification was performed with premelted calcium aluminate, the agitating energy being introduced by a large quantity of carrier gas.

Treatment No. 21:

In all 3 phases fine lime was injected in coinjection with flame coal (Phase I), magnesium and flame coal (Phase II) and fluorspar and flame coal (Phase III). The feed rates were kept constant.

Treatment No. 22:

In all 3 phases CaC5 was continuously injected.

Treatment No. 23:

The acid oxidic slag was substantially removed beforehand and 200 kg of fine lime packed in bags were added. Thereafter the lance was introduced and agitation was performed with 1800 N1/min of argon for 2.5 minutes. During Phases II and III fine lime was injected; at first salt-coated magnesium was added, followed by fluorspar, the quantity of gas being again increased in this phase to intensify the effects of agitation. The Mg flow rate was reduced linearly, the lime rate being kept constant.

Treatment No. 24:

In this treatment ball mill dust was continuously injected in all 3 phases for deoxidization, as an accompanying material and for slag conditioning. Limestone (Phase I) and salt-coated magnesium (Phase II) were added. In Phase III an increased gas flow rate was used.

Treatment No. 25:

Not magnesium, but CaD 7525 (75% industrial calcium carbide and 25% diamide lime) was used for desulphurization. This desulphurization agent is not as advantageous as, for example, CaC5 with magnesium (in coinjection), since it calls for long treatment periods and a higher iron loss takes place in the final slag, due to the larger quantity of slag and its high proportion of iron granules. The main aim was to reduce iron losses. The advantageous effect of fluorspar in this direction is known, but the desulphurization effect deteriorates in the case of admixture with CaD. In this case this did not take place, as the result shows. The slag was light and crumbly and did not contain much iron.

TABLE 1

| | | | | Reference: Examples | | | | | | | |
|---|---|---|---|---|---|---|---|---|---|---|---|
| Desulphurization agent | Serial No. | Quant. injected kg | Ladle Content t PI | Spec. quant. kg/t | Flow rate kg/min | Flow rate of carrier gas Nl/min | S content in % Start | S content in % End | Net consumption kg/t PI indust. carbide | Net consumption kg/t PI Mg | Net consumption kg/t PI Mg* |
| a) CaD 7525 | 1 | 1316 | 225 | 5.85 | 56 | 340 | 0.041 | 0.0083 | 4.39 | — | 0.66 |
| (75% indust. | 2 | 1818 | 231 | 7.87 | 62 | 380 | 0.054 | 0.0021 | 5.90 | — | 0.89 |
| calcium carbide | 3 | 1565 | 222 | 7.05 | 55 | 340 | 0.036 | 0.0013 | 5.30 | — | 0.80 |
| 25% diamide | 4 | 698 | 228 | 3.06 | 58 | 350 | 0.038 | 0.0120 | 2.30 | — | 0.35 |
| lime) | 5 | 1410 | 235 | 6.00 | 61 | 370 | 0.040 | 0.0031 | 4.50 | — | 0.68 |
| b) Mg 50 KMS | 6 | 368 | 347 | 1.06 | 28 | 850 | 0.038 | 0.0101 | — | 0.53 | 0.53 |
| 50% Mg, 50% ball | 7 | 632 | 355 | 1.78 | 22 | 830 | 0.043 | 0.0032 | — | 0.89 | 0.89 |
| mill dust) | 8 | 398 | 337 | 1.18 | 24 | 860 | 0.040 | 0.0081 | — | 0.59 | 0.59 |
| | 9 | 466 | 353 | 1.32 | 20 | 880 | 0.035 | 0.0060 | — | 0.66 | 0.66 |
| c) CaM 20 | 10 | 294 | 223 | 1.32 | 34 | 760 | 0.044 | 0.0120 | 1.00 | 0.26 | 0.41 |
| (75% indust. | 11 | 367 | 228 | 1.61 | 38 | 820 | 0.038 | 0.0060 | 1.22 | 0.32 | 0.50 |
| calcium carbide | 12 | 530 | 221 | 2.40 | 35 | 800 | 0.045 | 0.0020 | 1.82 | 0.48 | 0.75 |
| 20% Mg, 5% | 13 | 320 | 230 | 1.39 | 33 | 780 | 0.037 | 0.0060 | 1.06 | 0.28 | 0.44 |
| flame coal) | 14 | 653 | 225 | 2.90 | 36 | 810 | 0.043 | 0.0010 | 2.20 | 0.58 | 0.91 |

Mg* = Mg equivalent = Mg + 0.15 calcium carbide

TABLE 2

| | Examples according to the Invention | | |
|---|---|---|---|
| Treatment No. | 15 | 16 | 17 |
| Pig iron weight [t] | 232 | 227 | 226 |
| Initial S content [%] | 0.042 | 0.036 | 0.038 |
| Initial Phase | | | |
| Agent 1 | 90% CaO, 10% FK | 75% KMS, 25% limestone | 75% KMS 25% limestone |
| Flow rates [kg/min]/[Nl/min] | 83/450 | 63/520 | 59/510 |
| Injected quantity [kg] | 328 | 200 | 201 |
| Duration [min] | 4.2 | 3.2 | 3.4 |
| Middle Phase | | | |
| Agent 2 | CaM 20 | CaC5 | CaC5 |
| Flow rates [kg/min]/(Nl/min] | 20% Mg, 76% carbide, 4% FK 36/800 | 95% carbide, 5% FK 38/780 | 95% carbide, 5% FK 24→48/680→800 |
| Injected quantity [kg] | 328 | 258 | 255 |
| Duration [min] | 9.1 | 6.8 | 6.6 |
| Agent 3 | | Mg50KMS | Mg50KMS |
| Flow rates | | 19 | 27→12 |

TABLE 2-continued

| Treatment No. | Examples according to the Invention 15 | 16 | 17 |
|---|---|---|---|
| [kg/min]/[Nl/min] | | | |
| Injected quantity [kg] | | 128 | 127 |
| Duration [min] | | 6.8 | 6.6 |
| Final Phase | | | |
| Agent 4 | 80% $CaF_2$, 20% FK | CaC5 | CaC5 |
| Flow rates [kg/min]/[Nl/min] | 31/500 | 32/1200 | 33/1200 |
| Feed quantity [kg] | 80 | 120 | 126 |
| Duration [min] | 2.6 | 3.8 | 3.8 |
| Agent 5 | | calcium aluminate | calcium aluminate |
| Flow rates [kg/min]/[Nl/min] | | 21 | 21 |
| Injected quantity [kg] | | 80 | 78 |
| Duration [min] | | 3.8 | 3.8 |
| Final S content [%] | 0.0048 | 0.0034 | 0.0022 |
| Total consumptions | | | |
| Agent 1 [kg/t PI] | 1.50 | 0.88 | 0.89 |
| Agent 2 [kg/t PI] | 1.41 | 1.67 | 1.69 |
| Agent 3 [kg/t PI] | | 0.56 | 0.56 |
| Agent 4 [kg/t PI] | 0.34 | | |
| Agent 5 [kg/t PI] | | 0.35 | 0.35 |
| Mg equivalent (kg/t PI) | 0.44 | 0.52 | 0.52 |

KMS = ball mill dust, FK = flame coal

TABLE 3

| Treatment No. | Examples according to the Invention 18 | 19 | 20 |
|---|---|---|---|
| Pig iron weight [t] | 233 | 230 | 234 |
| Initial S content [%] | 0.047 | 0.036 | 0.040 |
| Initial Phase | | | |
| Agent 1 | 90% dolomite, 10% Al | 80% lime, 20% $CaF_2$ | 85% limestone 10% $CaF_2$ |
| Flow rates [kg/min]/[Nl/min] | 72/480 | 83/330 | 5% Al 83/400 |
| Injected quantity [kg] | 250 | 300 | 350 |
| Duration [min] | 3.5 | 3.6 | 4.2 |
| Aaent 5 | | FK | |
| Flow rates [kg/min]/[Nl/min] | | 9 | |
| Injected quantity [kg] | | 32 | |
| Duration [min] | | 3.6 | |
| Middle Phase | | | |
| Agent 2 | CaC5 | calcium carbide | CaM 20 37/800 |
| Flow rates [kg/min]/[Nl/min) | 28→62/650→850 | 22→56/780 | |
| Injected quantity [kg] | 244 | 276 | 408 |
| Duration [min] | 5.4 | 7.7 | 11.0 |
| Agent 3 | Mg60KMS | salt-coated Mg/94% Mg | |
| Flow rates [kg/min]/[Nl/min] | 23→12 | 14→5 | |
| Injected quantity [kg] | 92 | 69 | |
| Duration [min] | 5.4 | 7.7 | |
| Agent 5 | | FK | |
| Flow rates [kg/min]/[Nl/min] | | 4–7.5 | |
| Injected quantity [kg] | | 48 | |
| Duration [min] | | 7.7 | |
| Final Phase | | | |
| Agent 2 | CaC5 | calcium carbide | |
| Flow rates [kg/min]/[Nl/min] | 45/750 | 43/780 | |
| Injected quantity [kg] | 96 | 68 | |
| Duration [min] | 2.1 | 1.6 | |
| Agent 4 | $CaF_2$ | $CaF_2$ | Ca aluminate |
| Flow rates [kg/min]/[Nl/min] | 36 | 36 | 31/1.600 |
| Injected quantity [kg] | 77 | 58 | 120 |
| Duration [min] | 2.1 | 1.6 | 3.9 |

TABLE 3-continued

| Treatment No. | Examples according to the Invention 18 | 19 | 20 |
|---|---|---|---|
| Agent 5 | | FK | |
| Flow rates [kg/min]/[Nl/min] | | 9.5 | |
| Injected quantity [kg] | | 15 | |
| Duration [min] | | 1.6 | |
| Final S content [%] | 0.0051 | 0.0038 | 0.0036 |
| Total consumptions | | | |
| Agent 1 [kg/t PI] | 1.07 | 1.30 | 1.49 |
| Agent 2 [kg/t PI] | 1.46 | 1.50 | 1.74 |
| Agent 3 [kg/t PI] | 0.39 | 0.30 | |
| Agent 4 [kg/t PI] | 0.33 | 0.25 | 0.51 |
| Agent 5 [kg/t PI] | | 0.41 | |
| Mg equivalent (kg/t PI) | 0.44 | 0.51 | 0.55 |

TABLE 4

| Treatment No. | Examples according to the Invention 21 | 22 | 23 |
|---|---|---|---|
| Pig iron weight [t] | 229 | 236 | 225 |
| Initial S content [%] | 0.042 | 0.036 | 0.046 |
| Initial Phase | | | |
| Agent 1 | CaO | CaC5 | CaO |
| Flow rates [kg/min]/[Nl/min] | 82/380 | 25/420 | —/1.800 |
| Injected quantity [kg] | 230 | 82 | 200 |
| Duration [min] | 2.8 | 3.3 | 2.5 |
| Agent 2 | FK | limestone | |
| Flow rates [kg/min]/[Nl/min] | 9.6 | 22 | |
| Injected quantity [kg] | 27 | 73 | |
| Duration [min] | 2.8 | 3.3 | |
| Middle Phase | | | |
| Agent 1 | CaO | CaC5 | CaO |
| Flow rates [kg/min]/[Nl/min] | 38/650 | 27/650 | 38/720 |
| Injected quantity [kg] | 485 | 273 | 521 |
| Duration [min] | 12.6 | 10.1 | 13.7 |
| Agent 3 | salt-coated Mg (94%) | salt-coated Mg (94%) | salt-coated Mg (94%) |
| Flow rates [kg/min)/[Nl/min] | 11.0 | 8.2 | 16→5.5 |
| Injected quantity [kg] | 139 | 83 | 144 |
| Duration [min] | 12.6 | 10.1 | 13.7 |
| Agent 2 | FK | | |
| Flow rates [kg/min]/[Nl/min] | 4.7 | | |
| Injected quantity [kg] | 59 | | |
| Duration [min] | 12.6 | | |
| Final Phase | | | |
| Agent 1 | CaO | CaC5 | CaO |
| Flow rates [kg/min]/[Nl/min] | 59/420 | 38/900 | 38/1.400 |
| Injected quantity [kg] | 130 | 72 | 76 |
| Duration [min] | 2.2 | 1.9 | 2.0 |
| Agent 2 | FK | | |
| Flow rates [kg/min]/[Nl/min] | 13.2 | | |
| Injected quantity [kg] | 29 | | |
| Duration [min] | 2.2 | | |
| Agent 4 | $CaF_2$ | Ca aluminate | $CaF_2$ |
| Flow rates [kg/min]/[Nl/min] | 27.3 | 54 | 36 |
| Injected quantity [kg] | 60 | 103 | 72 |
| Duration [min] | 2.2 | 1.9 | 2.0 |
| Final S content [%] | 0.0043 | 0.0038 | 0.0022 |
| Total consumptions | | | |
| Agent 1 [kg/t PI] | 3.69 | 1.81 | 3.54 |
| Agent 2 [kg/t PI] | 0.50 | 0.31 | |
| Agent 3 [kg/t PI] | 0.61 | 0.35 | 0.64 |
| Agent 4 [kg/t PI] | 0.26 | 0.44 | 0.32 |
| Mg equivalent (kg/t PI) | 0.57 | 0.59 | 0.60 |

TABLE 5

| Examples according to the Invention | | |
|---|---|---|
| Treatment No. | 24 | 25 |
| Pig iron weight [t] | 227 | 233 |
| Initial S content [%] | 0.038 | 0.041 |
| Initial Phase | | |
| Agent 1 | KMS | 50% KMS, |
| Flow rates | 36/900 | 50% limestone |
| [kg/min)/[Nl/min] | | 32/360 |
| Injected quantity [kg] | 126 | 120 |
| Duration [min] | 3.5 | 3.7 |
| Agent 2 | limestone | |
| Flow rates | 25 | |
| [kg/minl/[Nl/min] | | |
| Injected quantity [kg] | 88 | |
| Duration [min] | 3.5 | |
| Middle Phase | | |
| Agent 1 | KMS | |
| Flow rates | 42/720 | |
| [kg/min]/[Nl/min) | | |
| Injected quantity [kg] | 590 | |
| Duration [min] | 14.0 | |
| Agent 3 | salt-coated | CaD 7525 |
| Flow rates | Mg (94%) | 61/380 |
| [kg/min]/[Nl/min] | 17→45 | |
| Injected quantity [kg] | 155 | 1110 |
| Duration [min] | 14.0 | 18.7 |
| Final Phase | | |
| Agent 1 | KMS | |
| Flow rates | 32/1.400 | |
| [kg/min]/[Nl/min] | | |
| Injected quantity [kg] | 100 | |
| Duration [min] | 3.1 | |
| Agent 3 | | CaD 7525 |
| Flow rates | | 61/360 |
| [kg/min]/[Nl/min] | | |
| Injected quantity [kg] | | 195 |
| Duration [min] | | 3.2 |
| Agent 4 | | $CaF_2$ |
| Flow rates | | 20.3 |
| [kg/min]/[Nl/min] | | |
| Injected quantity [kg] | | 65 |
| Duration [min] | | 3.2 |
| Final S content [%] | 0.0018 | 0.0021 |
| Total consumptions | | |
| Agent 1 [kg/t PI] | 3.59 | 0.51 |
| Agent 2 [kg/t PI] | 0.39 | |
| Agent 3 [kg/t PI] | 0.68 | 5.60 |
| Agent 4 [kg/t PI] | | 0.28 |
| Mg equivalent (kg/t PI) | 0.64 | 0.63 |

We claim:

1. A three-phase process for injecting fine-grained solids into a pig iron melt having an acid oxidized initial slag, comprising:

a) in a first phase, injecting solids into said melt that deoxidize and increase the basicity of said initial slag, and produce a circulatory movement of said melt;

b) in a second phase which follows said first phase, injecting into said melt at least one desulfurizing agent into said melt; and c) in a third phase which follows said second phase, injecting into said melt solids that purify said melt and produce a final desulfurization of said melt, and decrease an iron content of a desulfurization slag formed in said melt, said fine-grained solids being injected into said melt by a carrier gas via an injection lance.

2. A three-phase injection process for injecting fine-grained solids into a pig iron melt having an acid oxidized initial slag, comprising a) removing said acid oxidized initial slag from said melt;

b) in a first injection phase, injecting solids into said melt that form a basic deoxidized slag that covers said melt and produces a circulatory movement of said melt;

c) in a second injection phase which follows said first injection phase, injecting at least one desulfurizing agent into said melt; and d) in a third injection phase which follows said second injection phase, injecting solids into said melt that purify said melt and produce a final desulfurization of said melt, and decrease an iron content of a desulfurization slag formed in said melt, said fine-grained solids being injected into said melt by a carrier gas via an injection lance.

3. The process of claim 1 wherein said solids that increase the basicity of said initial slag comprise lime-containing solids, wherein said desulfurizing agent comprises a magnesium carrier or a calcium compound, and wherein said solids injected into said melt in said third phase comprise a calcium compound.

4. The process of claim 3 further comprising injecting into said melt a gas generating solid during said first, second, or third phase.

5. The process of claim 3 further comprising injecting into said melt a flux agent during said third phase.

6. The process of claim 1 wherein said solids injected in each of said individual first, second, and third phases are injected simultaneously into said melt, in amounts which depend upon the sulfur content in said melt.

7. The process of claim 1 wherein said solids injected in each of said individual first, second, and third phases are injected successively into said melt, said solids being injected in amounts which depend on the sulfur content in said melt.

8. The process of claim 1 wherein each of said fine-grained solids are supplied individually from separate pressurized feed vessels and injected into said melt via a common conveying pipe connected to said injection lance.

9. The process of claim 1 wherein said fine-grained solids are supplied as mixtures from separate pressurized feed vessels and are injected into said melt via a common conveying pipe connected to said injection lance.

10. The process of claim 1 wherein the amount of carrier gas injected into said melt depends on the quantity of fine-grained solids injected into said melt and the total quantity of agitating gas Vg that a dissipated agitating energy $ED_{diss}$ is produced in the melt of at least 100 watts per tonne of pig iron, according to the equation:

$$ED_{diss} = \frac{6.2 \times Vg \times T_1 \times In\left(1 + \frac{\rho_1 \times g \times H_b}{10^5 \times P_o}\right)}{G_{schm}}$$

wherein:

Vg=sum of the quantity of injected carrier gas, the quantity of gas released by gas generation in the melt, and the quantity of gas due to the evaporation of metallic magnesium from magnesium carriers $T_1$=temperature of the melt in °K, g=gravitational constant in $m/s^2$, $\rho_1$=density of the melt in $kg/m^3$, $H_b$=height of the melt through which gas bubbles flow in m, $P_0$=pressure over the melt in bar, and $G_{schm}$=weight of the melt treated in tonne.

11. The process of claim 10 wherein the dissipated energy density $ED_{diss}$ is in the range of between 200 and 1000 watts per tonne of pig iron.

12. The process of claim 10 wherein the dissipated energy density $ED_{diss}$ in said first phase is in the range of between 600 and 1000 watts per tonne of pig iron, and in said second and third phases is in the range of between 200 and 700 watts per tonne of pig iron.

13. The process of claim 3 wherein the quantity of injected magnesium carrier per unit time is reduced as the sulfur content in said melt drops, wherein the quantity of injected calcium compound per unit time is increased, and wherein the quantity of gas in said melt increases per unit time.

14. The process of claim 3 wherein said lime-containing solids are selected from the group consisting of lime (CaO), limestone ($CaCO_3$), and dolomite.

15. The process of claim 4 wherein said gas generating solid for said first phase is selected from the group consisting of flame coal, gas flame coal, lignite, limestone, and dolomite.

16. The process of claim 4 wherein said gas generating solid for said second and third phases is selected from the group consisting of bright-burning coal, long-flamed gas coal, lignite, and diamide lime.

17. The process of claim 1 wherein said deoxidizing solids are selected from the group consisting of aluminum and polyethylene.

18. The process of claim 3 wherein said calcium compound is selected from the group consisting of flowable reactive lime, and industrial calcium carbide.

19. The process of claim 3 wherein said magnesium carrier is selected from the group consisting of metallic magnesium and metallic magnesium with lime, $CaC_2$, calcium aluminates, aluminum-containing ball mill dust, alumina, or magnesium oxide.

20. The process of claim 5 wherein said flux agent is selected from the group consisting of fluorspar and soda ash (sodium carbonate).

21. The process of claim 3 wherein said lime-containing solids are mixed with an aluminum-containing solid.

22. The process of claim 3 wherein said lime-containing solids comprise a calcium carbide carrier mixed with an aluminum-containing solid.

23. The process of claim 21 wherein said aluminum-containing solid is selected from the group consisting of aluminum, crude or secondary aluminum, and aluminum-containing ball mill dust.

* * * * *